US012127659B2

(12) United States Patent
Shannon et al.

(10) Patent No.: US 12,127,659 B2
(45) Date of Patent: Oct. 29, 2024

(54) COSMETIC PRODUCT CONTAINER AND RETENTION MECHANISM

(71) Applicant: ELC MANAGEMENT LLC, Melville, NY (US)

(72) Inventors: Steven Dean Shannon, Roselle, IL (US); Gianluca Mattaroccia, Sunnyside, NY (US); Timothy Hugh Calvert, Brentwood, TN (US)

(73) Assignee: ELC MANAGEMENT LLC, Melville, NY (US)

( * ) Notice: Subject to any disclaimer, the term of this patent is extended or adjusted under 35 U.S.C. 154(b) by 62 days.

(21) Appl. No.: 17/956,484

(22) Filed: Sep. 29, 2022

(65) Prior Publication Data

US 2024/0108118 A1 Apr. 4, 2024

(51) Int. Cl.

| | |
|---|---|
| ***B43K 21/08*** | (2006.01) |
| ***A45D 40/00*** | (2006.01) |
| ***A45D 40/02*** | (2006.01) |
| ***A45D 40/06*** | (2006.01) |

(52) U.S. Cl.

CPC ..... *A45D 40/00* (2013.01); *A45D 40/02* (2013.01); *A45D 40/023* (2013.01); *A45D 40/06* (2013.01); *A45D 40/065* (2013.01); *A45D 2040/0025* (2013.01); *A45D 2040/0062* (2013.01)

(58) Field of Classification Search

CPC ..... A45D 40/02; A45D 40/023; A45D 40/04; A45D 40/06; A45D 40/065; A45D 2040/0062

See application file for complete search history.

(56) References Cited

U.S. PATENT DOCUMENTS

| | | | | |
|---|---|---|---|---|
| 5,865,550 | A | 2/1999 | Bouix | |
| 6,126,351 | A | 10/2000 | Gueret | |
| 10,098,436 | B2 * | 10/2018 | Bonnin | A45D 40/06 |
| 10,172,433 | B2 * | 1/2019 | Kikuchi | A45D 40/02 |
| 11,337,505 | B2 | 5/2022 | Zhong | |
| 11,684,138 | B1 * | 6/2023 | Yan | A45D 40/065 401/53 |
| 2016/0183662 | A1 | 6/2016 | Heraud | |

FOREIGN PATENT DOCUMENTS

| | | | |
|---|---|---|---|
| EP | 0872194 | A1 | 10/1998 |
| EP | 3878310 | A1 | 9/2021 |
| FR | 0940103 | A1 * | 9/1999 |
| FR | 3074023 | A1 | 5/2019 |

OTHER PUBLICATIONS

International Application No. PCT/US2023/075295, International Search Report and Written Opinion, mailed Jan. 24, 2024.

* cited by examiner

*Primary Examiner* — Jennifer C Chiang
(74) *Attorney, Agent, or Firm* — MARSHALL, GERSTEIN & BORUN LLP

(57) ABSTRACT

A cup for retaining a cosmetic substance includes a cup body having a first end, a second end, and an inner sidewall forming a cup cavity and a stepped retention member disposed on the inner sidewall of the cup body and extending into the cup cavity. The stepped retention member has a first width value extending around the periphery of the inner sidewall.

18 Claims, 10 Drawing Sheets

COSMETIC PRODUCT CONTAINER AND RETENTION MECHANISM

FIELD OF THE DISCLOSURE

The present disclosure generally relates to cosmetic, hair care, body care, and/or skincare products and, more particularly, to systems and approaches for containing and retaining such products.

BACKGROUND

Cosmetic, hair care, body care, and/or skincare products may be provided in a number of different containers, and may be applied using a number of varying approaches. As an example, a lipstick or lip balm product may be in the form of an elongated tube, cylinder, square, rectangular, and/or diamond prism, among other shapes that is disposed in a protective container. Such containers may allow the cosmetic substance to selectively advance to an extended position relative to the container to be applied by the user. The cosmetic substance may be a generally solid, yet relatively soft, molded composition that may be inserted into a cavity of a retaining cup. In the event the container is inadvertently dropped or otherwise jostled, the cosmetic substance may become damaged, broken, or otherwise detached from the retaining cup. In some examples, the retaining cup (or other features of the container) may include discrete retention members in the form of hooks, nodules, or similar components that may be urged into the cosmetic substance in an attempt to prevent or otherwise limit movement of the cosmetic substance relative to the cup and the container during these inadvertent drops or bumps. However, these features may create localized stress points that may ultimately deform or otherwise damage the cosmetic substance.

Accordingly, there is a need for improved accessories having improved functionalities.

SUMMARY

Examples within the scope of the present disclosure are directed to a cosmetic product container and retention mechanism that may include a cup for retaining a cosmetic substance. The cup includes a cup body having a first end, a second end, and an inner sidewall forming a cup cavity and a stepped retention member disposed on the inner sidewall of the cup body and extending into the cup cavity. The stepped retention member has a first width value extending around the periphery of the inner sidewall.

In some examples, the stepped retention member includes a plurality of angled protrusions extending inwardly into the cup cavity. In some of these examples, each of the angled protrusions may include a side surface and a lower surface. The side surface may define a side surface area value and the lower surface may define a lower surface area value. The ratio of the side surface area value to the lower surface area value may be between approximately 4:1 and approximately 12:1.

In some examples, the cup may further include a second retention member disposed on the inner sidewall of the cup body and extending into the cup cavity. The second retention member may have a second width value extending around the periphery of the inner sidewall. In these examples, the first width value may be greater than the second width value. In some of these forms, the second retention member includes an elongated notch having a first end, a second end, and an undercut formed at the second end thereof. The cup may further include a cup retention member disposed on an outer surface of the cup body. The cup retention member may be aligned with the second retention member.

In an approach, the cup may include a floor member positioned at or near the stepped retention member.

In accordance with a second aspect, a cosmetic product container includes an outer container having first and second ends and defining a container cavity, a cup adapted to be at least partially disposed within the container cavity, and a cosmetic substance having first and second ends and an elongated body therebetween. The cup includes a cup body having first and second ends and an inner sidewall forming a cup cavity and a stepped retention member disposed on the inner sidewall of the cup body and extending into the cup cavity. The stepped retention member has a first width value extending around the periphery of the inner sidewall. At least a portion of the elongated body of the cosmetic substance is disposed within the cup cavity.

BRIEF DESCRIPTION OF THE DRAWINGS

The above needs are at least partially met through provision of one, more than one, or any combination of the cosmetic product containers and retention mechanisms described in the following detailed description, particularly when studied in conjunction with the drawings, wherein.

Figure 1:
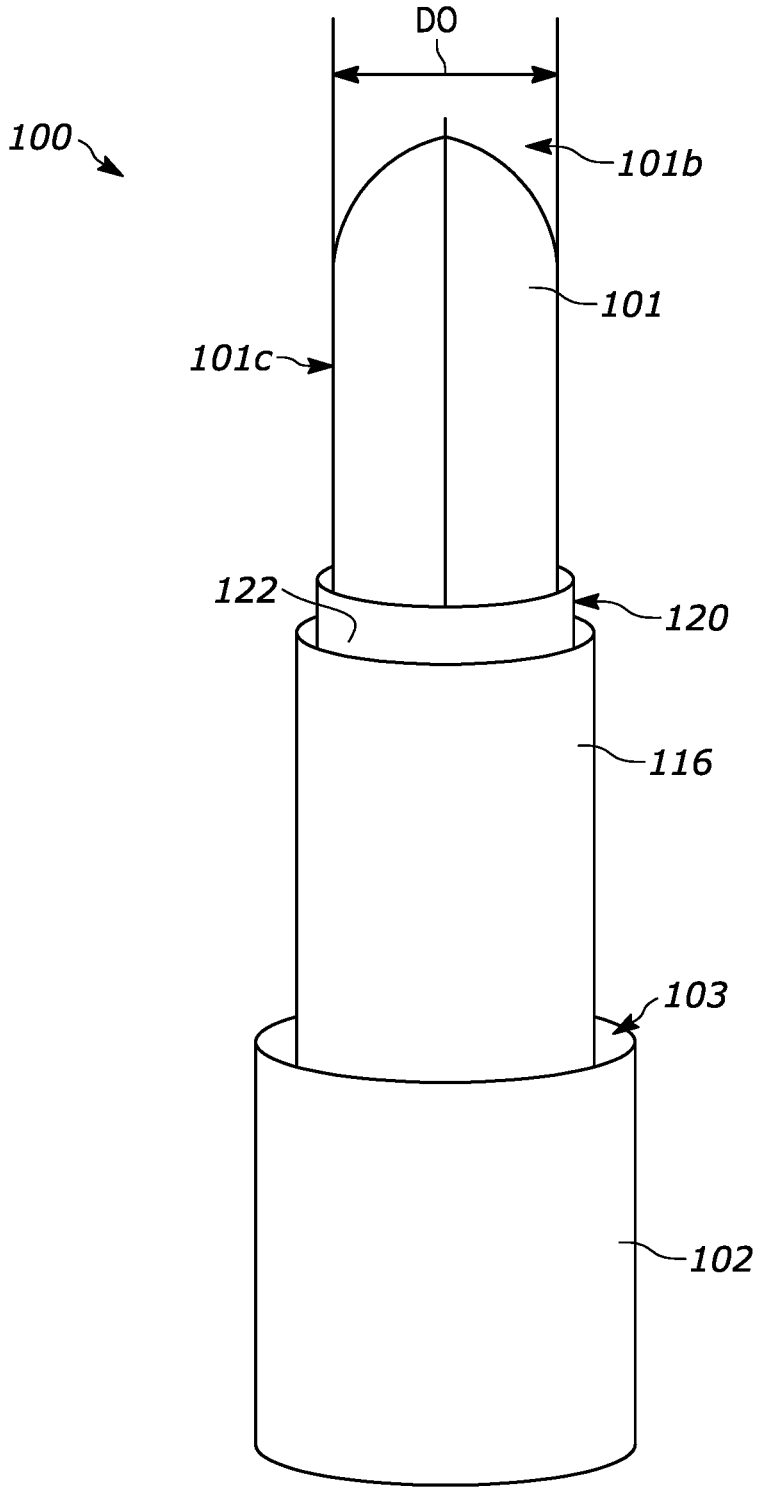
FIG. 1 illustrates a front elevation view of an example cosmetic product in accordance with various examples.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various examples. Also, common but well-understood elements that are useful or necessary in a commercially feasible examples are often not depicted in order to facilitate a less obstructed view of these various examples. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above except where different specific meanings have otherwise been set forth herein.

DETAILED DESCRIPTION

Generally speaking, pursuant to these various approaches, cosmetic product containers and retention mechanisms are provided that adequately retain a cosmetic substance during use as well as in the event of inadvertent drops and/or bumps. The approaches described herein provide firm retention of the cosmetic substance while reducing or eliminating potentially harmful stress regions. As such, the systems described herein may be used to contain and retain a multitude of cosmetic substances having varying degrees of material softness.

Turning to the Figures, a cosmetic product 100 is provided for containing and applying a cosmetic substance 101. The cosmetic product 100 includes a base 102, a track 108, an inner body 112, a shell 116, and a retention mechanism 120. In the illustrated examples, the cosmetic substance 101 is in the form of a lipstick or lip balm product. It is to be appreciated that the cosmetic substance 101 may be any type of cosmetic, hair care, body care, and/or skincare product that may be applied to a user. Other examples are possible. In some of these examples, the cosmetic substance 101 may include strong or otherwise aggressive chemicals and/or ingredients such as, for example, volatiles. The cosmetic substance 101 includes a first end 101*a*, a second end 101*b*, and an elongated body 101*c* extending therebetween along a longitudinal axis ("A"). Further, the cosmetic substance 101 defines an outer cross-sectional dimension ("DO"). In the illustrated examples, the outer cross-sectional dimension DO is in the form of an outer diameter or circumference. However, other examples are possible.

Generally speaking, the base 102 at least partially retains components of the cosmetic product 100 in a base cavity 103. The base cavity 103 defines a ledge 104 formed on an inner surface, and further includes a securement mechanism 105 formed on an outer surface thereof. The securement mechanism 105 may be used to engage a portion of a cap (not illustrated) to conceal the cosmetic substance 101 for storage purposes. Any number of suitable securement mechanisms 105 may be used such as, for example, a snap-fit coupling, a friction-fit coupling, a threaded connection, and the like. Other examples are possible.

The track 108 is at least partially disposed within the base cavity 103 and includes a first end 108*a* and a second end 108*b* and defines a channel 109. The inner body (which, in some examples, may be referred to as an outer container) 112 is at least partially disposed within the base cavity 103 and includes an inner surface 113 and a notch 114. The shell 116 is also at least partially disposed within the base cavity 103 and is provided to prevent a user from observing these components. The shell 116 includes a lip 117 that engages a portion of the inner body 112 to restrict movement in a direction along the longitudinal axis A. It is to be appreciated that any of the base 102, the track 108, the inner body 112, and/or the shell 116 may include any number of additional features and/or components to assist in use of the cosmetic product 100, but for the sake of brevity, such features and/or components will not be discussed in substantial detail herein.

The retention mechanism 120 is provided to securely retain the cosmetic substance 101. The retention mechanism 120 includes a cup 122 having a cup body 124. The cup body 124 includes a first end 124*a*, a second end 124*b*, an inner sidewall 124*c*, and a cup cavity 125. Generally speaking, the cosmetic substance 101 is at least partially disposed within the cup cavity 125. The cup body 124 further includes a cup retention member 130. The cup body 124 may be formed from any number of desired materials.

Figure 2:
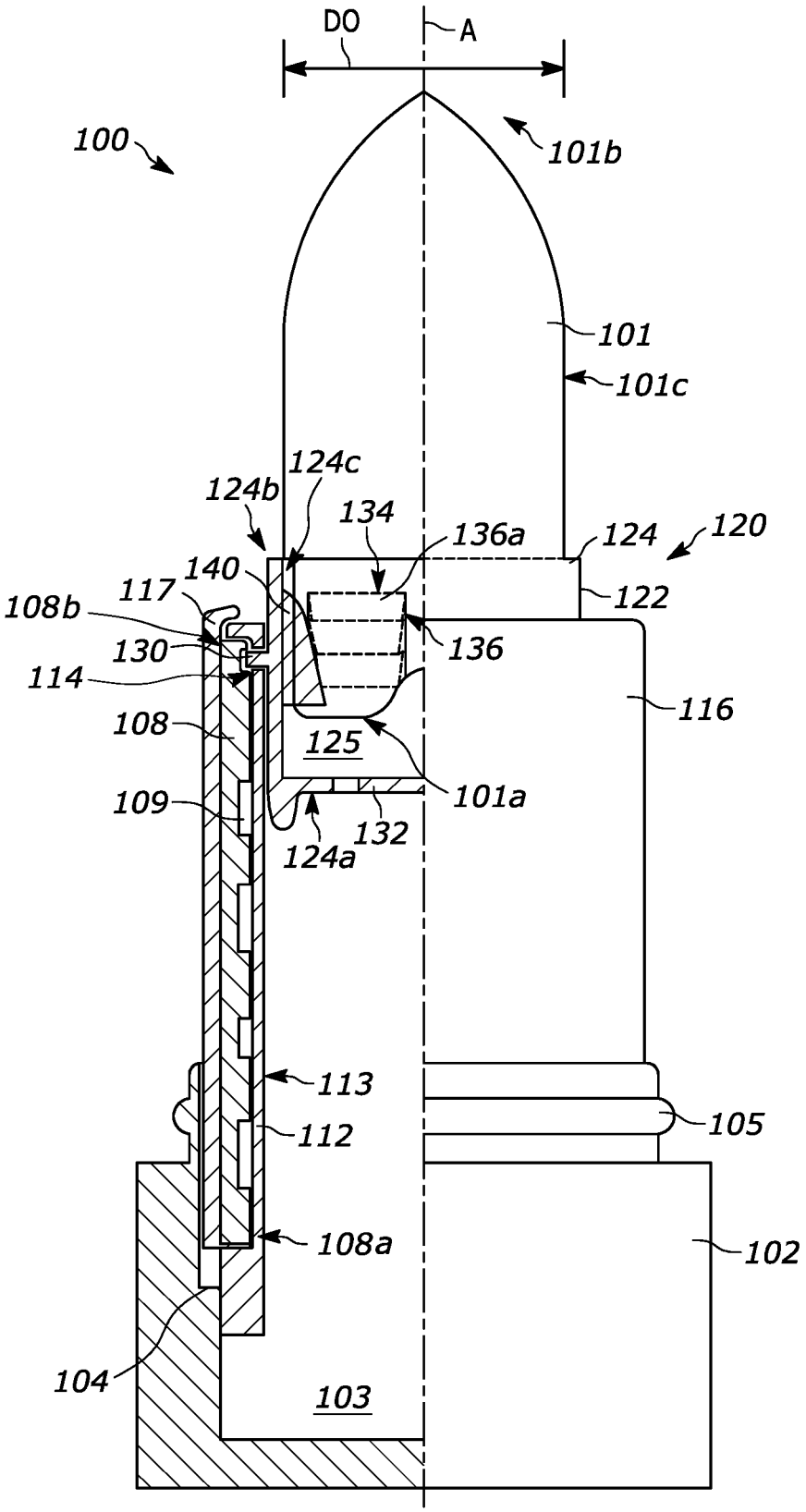
FIG. 2 illustrates a partial cross-sectional front elevation view of the example cosmetic product of FIG. 1 having an example retention mechanism in accordance with various examples.
Figure 3:
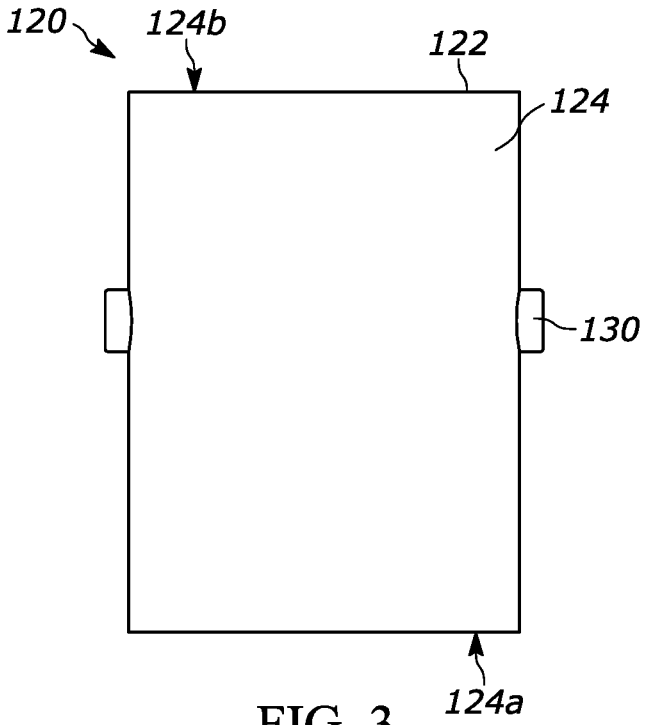
FIG. 3 illustrates a front elevation view of the example retention mechanism of FIGS. 1 & 2 in accordance with various examples.

With reference to FIG. 2, the cup body 124 is adapted to be disposed within the inner body 112. Upon coupling the cup body 124 with the inner body 112, the cup retention member 130 is positioned within the notch 114 of the inner body 112 to prevent or otherwise limit relative movement between the inner body 112 and the cup body 124. In some of these examples, such coupling between the inner body 112 and the cup body 112 may exert an inwardly-directed urging or compressive force.

The cup body 124 further includes any number of stepped retention members 134 disposed on the inner sidewall 124*c*. Each stepped retention member 134 includes any number of angled protrusions or ridges 136 that extend into the inner cavity 125 in a stepped pattern. It is to be appreciated that while each of the illustrated stepped retention members 134 includes four angled protrusions 136, fewer or more than four angled protrusions 136 may be used to improve retention of the cosmetic substance 101.

Figure 4:
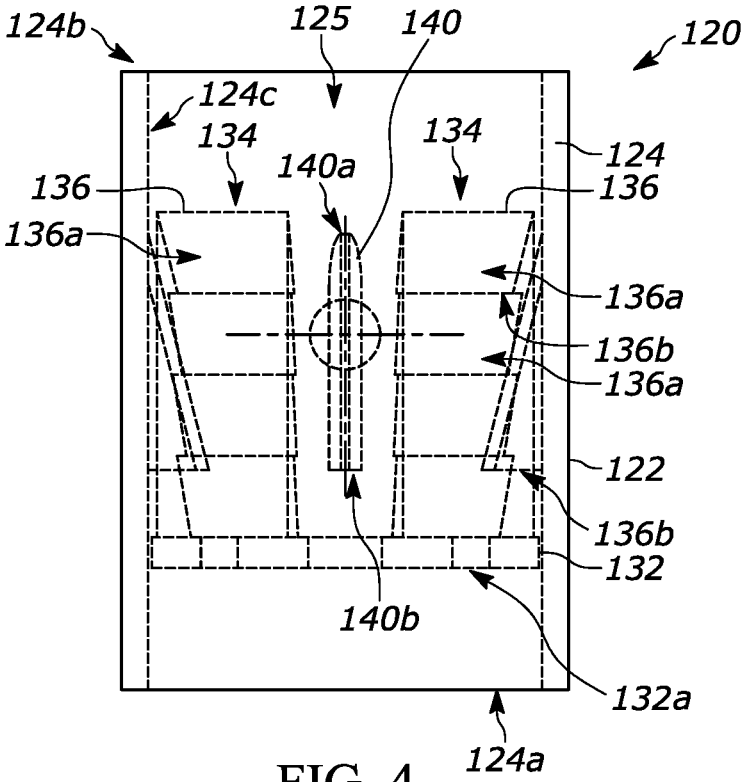
FIG. 4 illustrates a side elevation view of the example retention mechanism of FIG. 3 in accordance with various examples.
Figure 5:
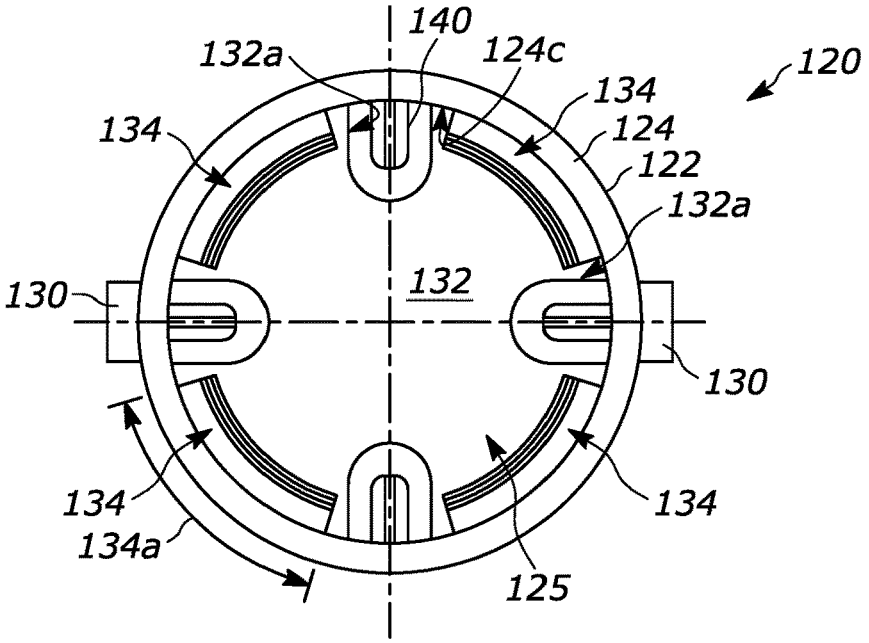
FIG. 5 illustrates a top plan view of the example retention mechanism of FIGS. 3 and 4 in accordance with various examples.
Figure 6:
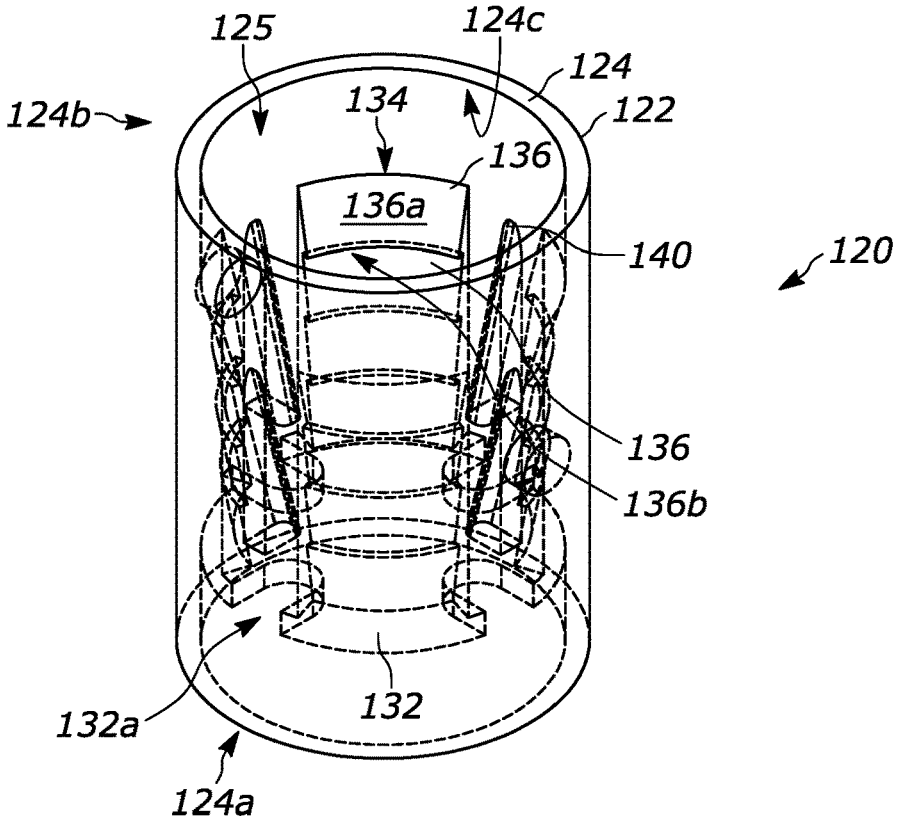
FIG. 6 illustrates a perspective view of the example retention mechanism of FIGS. 3-5 in accordance with various examples.
Figure 7:
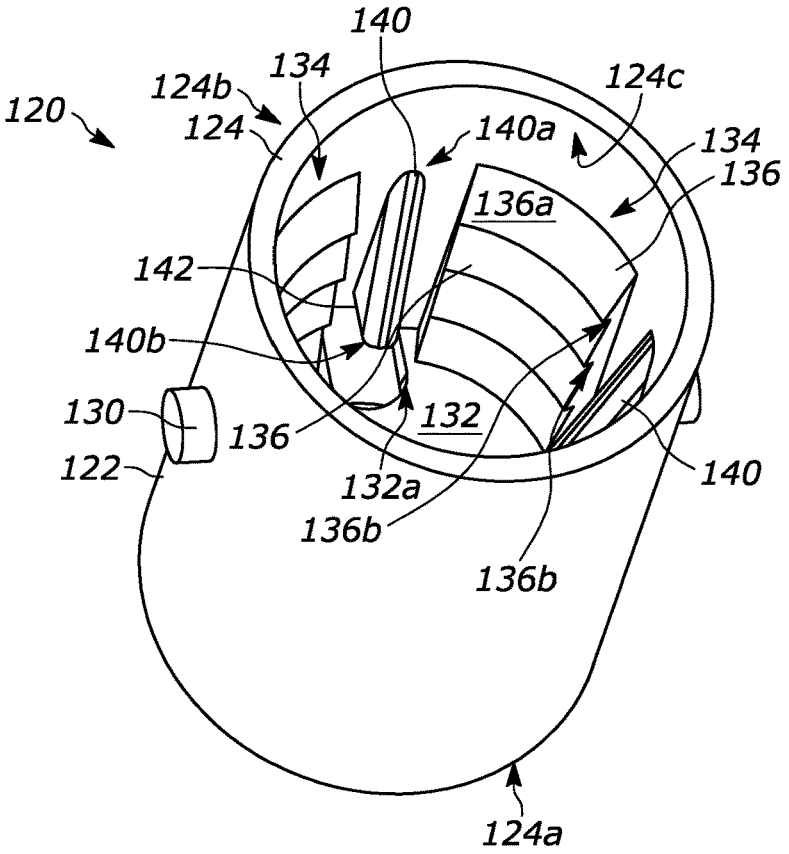
FIG. 7 illustrates an upper perspective view of the example retention mechanism of FIGS. 3-6 in accordance with various examples.
Figure 8:
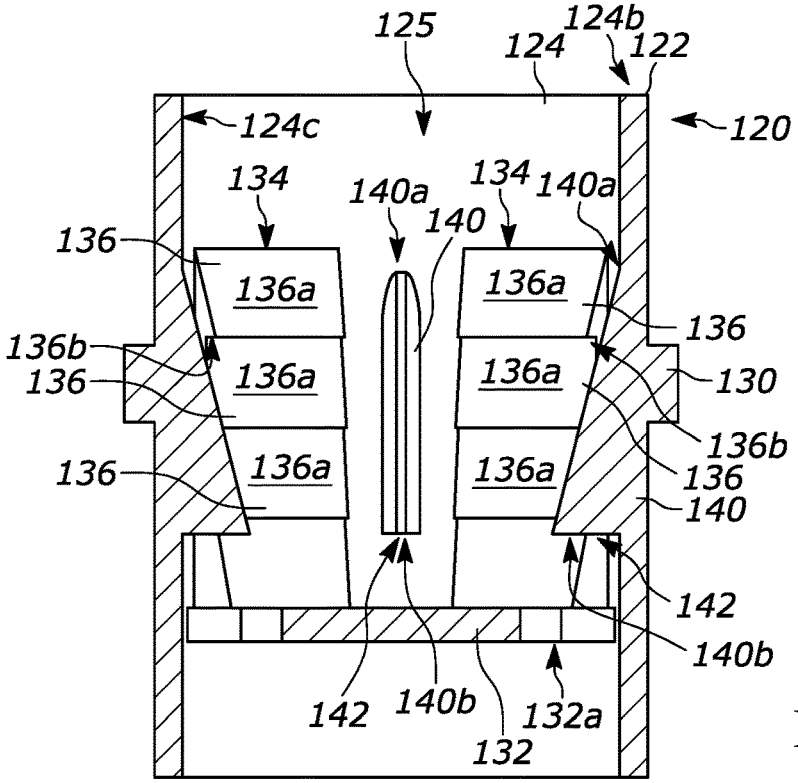
FIG. 8 illustrates a cross-sectional front elevation view of the example retention mechanism of FIGS. 1-7 in accordance with various examples.
Figure 9:
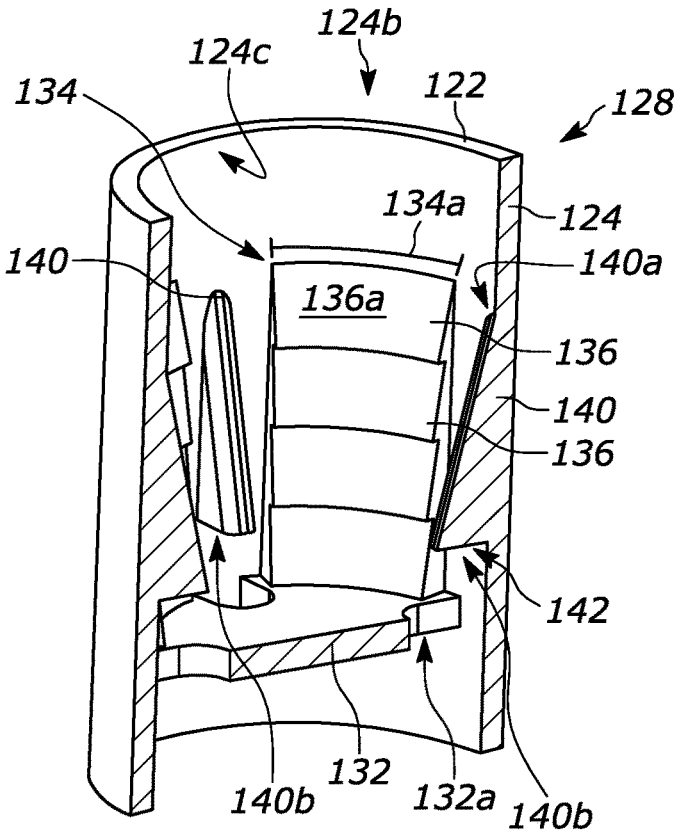
FIG. 9 illustrates a cross-sectional perspective view of the example retention mechanism of FIGS. 1-8 in accordance with various examples.
Figure 10:
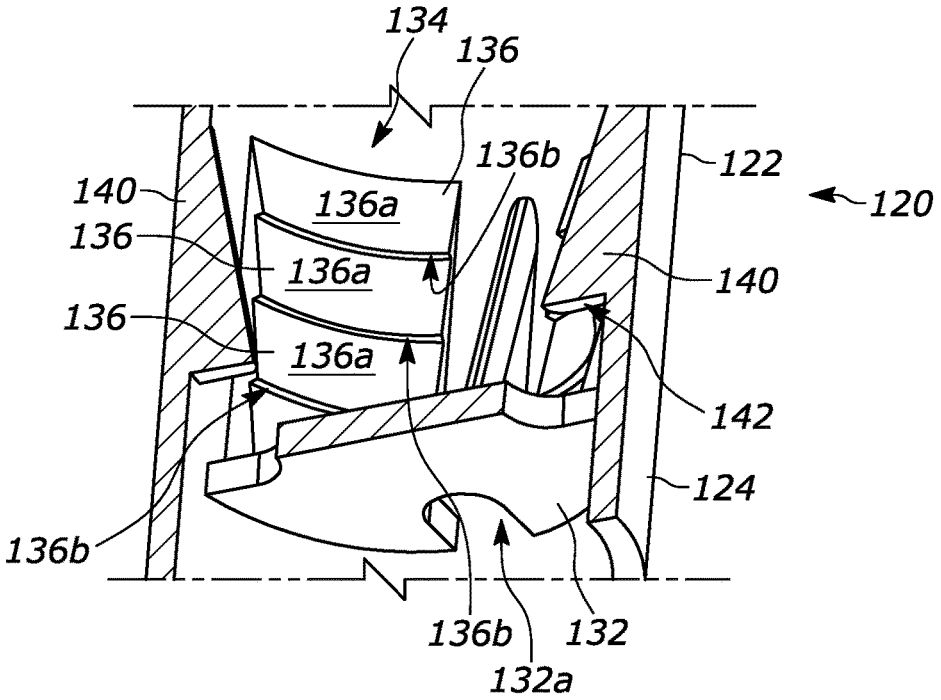
FIG. 10 illustrates a cross-sectional lower perspective view of the example retention mechanism of FIGS. 1-9 after insertion of a cosmetic substance in accordance with various examples.

Each angled protrusion 136 includes a side surface 136*a* and a lower surface 136*b* that cooperate to form a step or undercut (see FIGS. 4 & 10). Further, each angled protrusion 136 extends along the inner sidewall 124*c* a first dimension or width value 134*a*. As shown in the Figures, this first dimension value 134*a* is generally wide or elongated in that the stepped retention member 134 extends around approximately 20% of the inner periphery of the cup body 124 or more. It is to be appreciated that the first dimension value 134*a* may be modified to improve retaining performance of cosmetic substances 101 having varying material characteristics such as, for example, softness and the like.

As previously noted, the lower surface 136*b* of each angled protrusion 136 forms an undercut region. The lower surface 136*b* has a relatively shallow depth or shortened profile, and as such, does not extend into the cup cavity 125 as much or as far as previous designs. Such an arrangement is in contrast to existing systems that protrude or extend further into the cup cavity in an attempt to provide a greater retaining force with the cosmetic substance. In the present application, the lower surface 136*b* is dimensioned to be relatively shallow and have a less aggressive undercut depth to allow cosmetic substances 101 formed from softer compositions to better flow into these regions below the lower surface 136*b*, whereas existing systems may have resulted in a void area that does not include any cosmetic substance. Such a void area in previously-used systems could result in a lessened surface area contact between the cup and the cosmetic substance. Further, cosmetic substances 101 formed from softer compositions may become structurally weakened by more aggressive undercut depths, and as such, the angled protrusions 136 described in the present disclosure may better maintain the structural integrity of the cosmetic substance 101.

Each side surface 136*a* of the angled protrusion 136 defines a side surface area value. Each side surface 136*a* may be generally concave in that it has a curvature that is similar to or the same as the curvature of the curved inner sidewall 124*c*. Further, each lower surface 136*b* of the angled protrusion 136 defines a lower surface area value. In some examples, the ratio of the side surface area value to the side surface area value is between approximately 4:1 and approximately 12:1. Other examples are possible.

In some examples, the cup body 124 may additionally include a floor member 132 positioned at or near the first end 124*a* thereof. This floor member 132 may provide additional support for the first end 101*a* of the cosmetic substance 101. In some examples, the stepped retention member 134 may extend to or terminate at the floor member 132. In other examples, a gap (not illustrated) may be defined between a lowermost angled protrusion 136 of the stepped retention member 134 and the floor member 132. Further, in some examples, the floor member 132 may include a number of through bores or channels 132*a*.

To assemble the cosmetic product 100, the cup body 124 is coupled with the inner body 112 to retain the cup body 124 in a relatively fixed position with respect to the longitudinal axis A. However, in other examples, the cup body 124 may not be coupled with the inner body 112 at this point. The first end 101*a* of the cosmetic substance 101 is then inserted into the cup cavity 125. Because the outer cross-sectional dimension DO of the cosmetic substance 101 is similar to an inner cross-sectional dimension of the inner sidewall 124*c*, such insertion of the cosmetic substance 101 causes a portion of the elongated body 101*c* of the cosmetic substance 101 to contact the inner sidewall 124*c* in addition to each stepped retention member 134. Inserting the cosmetic substance 101 into the cup cavity 125 causes each angled protrusion 136 to gently insert into a portion of the cosmetic substance 101. As previously noted, the broad ridges of the side surfaces 136*a* of the angled protrusions 136 create increased surface area, and thus frictional, contact with the cosmetic substance 101, and the cosmetic substance 101 may flow into the area below the lower surface 136*b* of each angled protrusion 136, thereby creating additional surface area contact with the lower surfaces 136*b*. These factors, combined with the multiple ridge steps allow for better hold on an outer surface of the cosmetic substance 101.

Accordingly, the stepped retention member or members 134 apply a gentle retaining force against the elongated body 101*c* of the cosmetic substance 101. It is to be appreciated that any number of characteristics such as, for example, any number of desired dimensions of the stepped retention member 134 and/or material characteristics of the cosmetic substance 101 may be modified to generate a relatively gentle or relatively firm retention force against the cosmetic substance 101 without causing excessive damage or deformation along the elongated body 101*c* due to the significant surface area contact between the angled protrusions 136 and the elongated body 101*c*. In some approaches, material properties of the cosmetic substance 101 may dictate the quantity and dimensions of each stepped retention member 134 to ensure the cosmetic substance 101 is not damaged or otherwise deformed during insertion or use.

With reference to FIG. 2, upon assembling the retention mechanism 120 within the inner body 112, the cup retention member 130 (which, in some examples protrudes outwardly from the notch 114 of the inner body 112 is inserted into the channel 109 of the track 108. The lip 117 of the shell 116 may then be positioned over the inner body 112, and these components may then be inserted into the base cavity 103 of the base 102 until the shell 116 engages the ledge 104. In some examples, the shell 116, the track 108, and/or the inner body 112 may be fixed relative to the base 102 while the cup 122 may be rotatable relative thereto. As such, to advance the cosmetic substance 101, causing it to protrude outwardly beyond the shell 116, a user may twist the base to cause the cup retention member 130 to advance along the channel 109.

In some examples, the retention mechanism 120 may include any number of optional features. For example, as illustrated in FIGS. 2 and 4-10, the cup body 124 may additionally include any number of optional second retention members 140 in the form of elongated ribs or notches that extend or protrude into the cup cavity 125. Each of these second retention members 140 may include a first end 140*a*, a second end 140*b*, and an undercut 142 formed at the second end 140*b*. The second retention members 140 may have a width dimension value that is less than the width value 134*a* of the stepped retention member 134. In some forms, the second retention members 140 may be inversely tapered relative to the stepped retention members 134. Further, while the illustrated second retention members 140 are provided as being oriented generally vertically (i.e., generally parallel to the longitudinal axis L), in some examples, the second retention members 140 may be arranged in a helical or other arrangement (not illustrated). Other arrangements are possible.

Upon inserting the cosmetic substance 101 into the cup cavity 125, the cosmetic substance 101 may additionally at least partially encapsulate the second retention members 140, whereupon the second retention members 140 may restrict or otherwise limit rotation of the cosmetic substance 101 with respect to the cup cavity 125 about the longitudinal axis A. In other examples, the cosmetic substance 101 may be inserted into the cup cavity 125 via other approaches such as, for example, any number of backfilling techniques. In any of these filling techniques, the retention members 140 restrict or otherwise limit rotation of the cosmetic substance 101.

It is to be appreciated that while the second retention members 140 are illustrated in the Figures, these second retention members 140 are merely optional features and are not required for the cup 122 to retain the cosmetic substance 101. Further, it is to be appreciated that while the second retention members 140 are oriented in a generally parallel direction with respect to the longitudinal axis A, in some arrangements, any number of the second retention members 140 may be oriented in a non-parallel direction with respect to the longitudinal axis A (e.g., any number of second retention members 140 may form a spiral or helix about the inner sidewall 124*c* of the cup body 124). Other arrangements are possible.

It is also to be appreciated that the retention mechanism 120 may be provided in any number of varying shapes and/or configurations. As non-limiting alternative examples, FIGS. 11-14 illustrate alternative retention mechanisms 220, 320 that may be incorporated into the cosmetic product 100. These retention mechanisms 220, 320 include similar features as the retention mechanism 120, and as such, are provided with reference numerals having identical two-digit suffixes. For the sake of brevity, such components will not be described in further detail. In these examples, the retention mechanisms 220, 320 may be used in conjunction with backfilling manufacturing approaches. More specifically, the floor members 232, 332 may include a primary opening 232*a*, 332*a* that, in the illustrated examples, is approximately centrally located on the floor member 232, 332 to allow the cosmetic substance 101 to be filled into the cup cavity 225, 325. In other examples, the primary opening 232*a*, 332*a* may not be centrally located.

Figure 11:
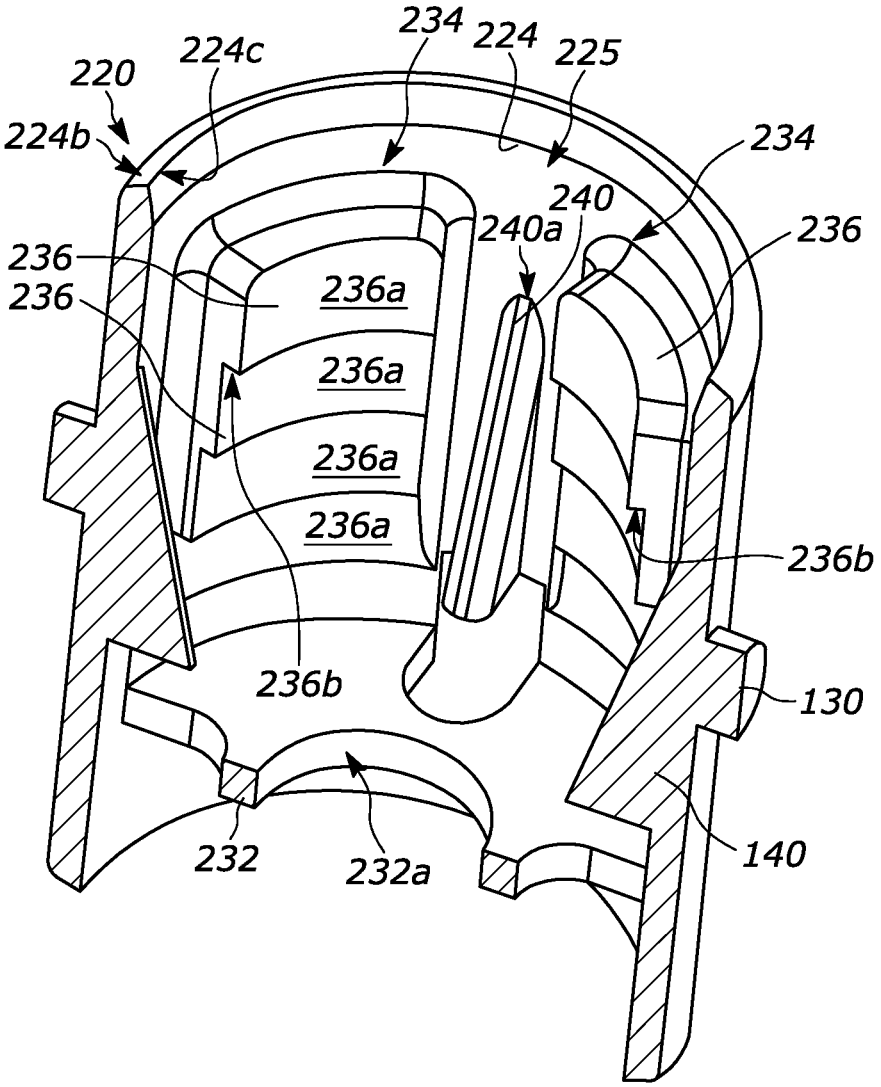
FIG. 11 illustrates a cross-sectional perspective view of a second example retention mechanism in accordance with various examples.
Figure 12:
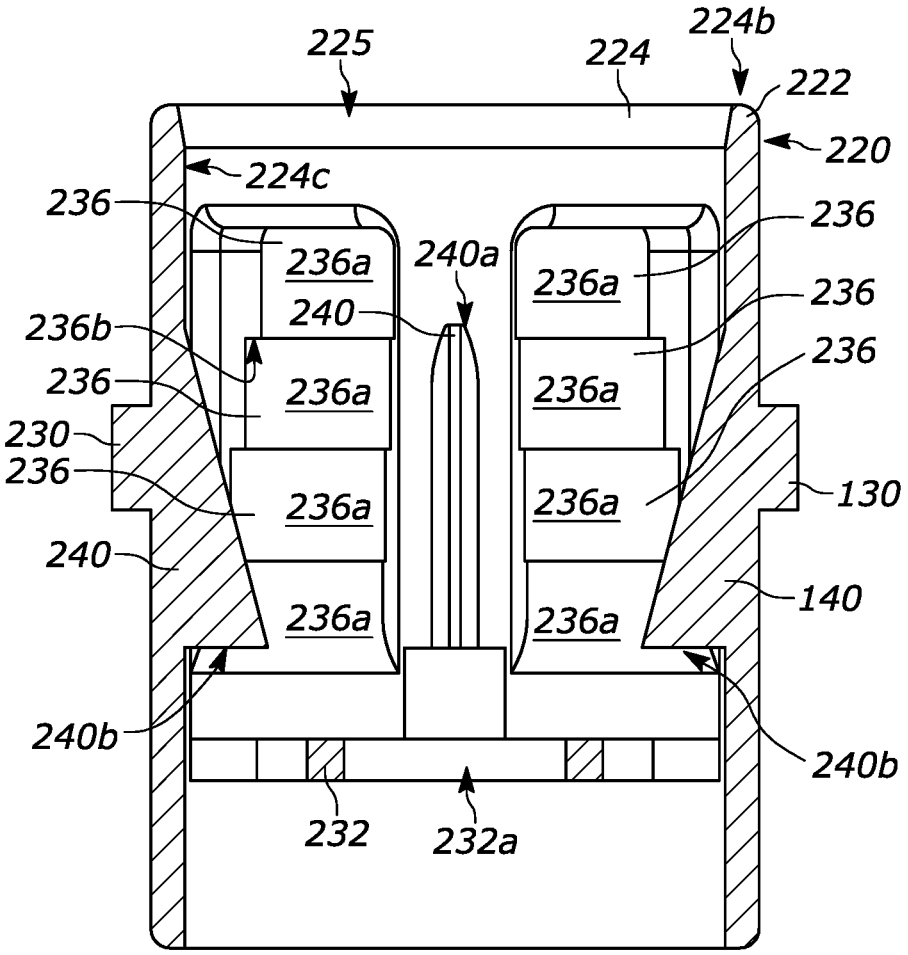
FIG. 12 illustrates a cross-sectional front elevation view of the example retention mechanism of FIG. 11 in accordance with various examples.
Figure 13:
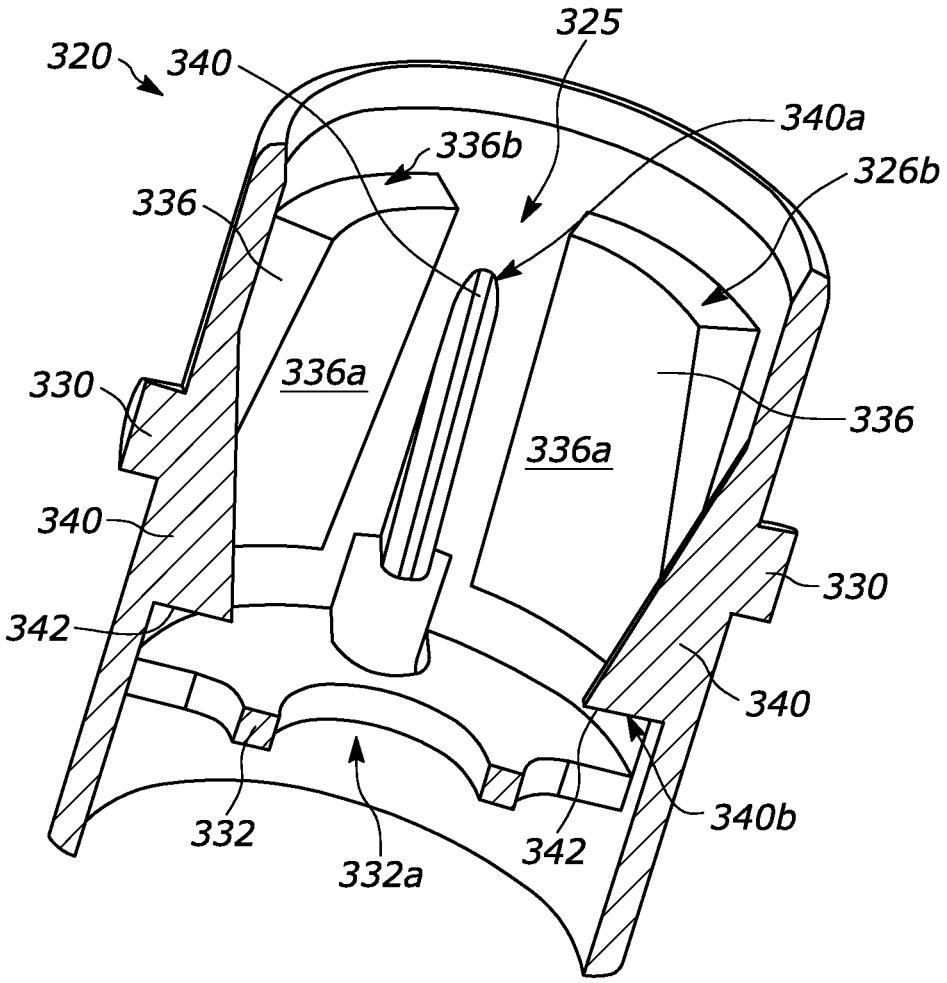
FIG. 13 illustrates a cross-sectional perspective view of a third example retention mechanism in accordance with various examples.
Figure 14:
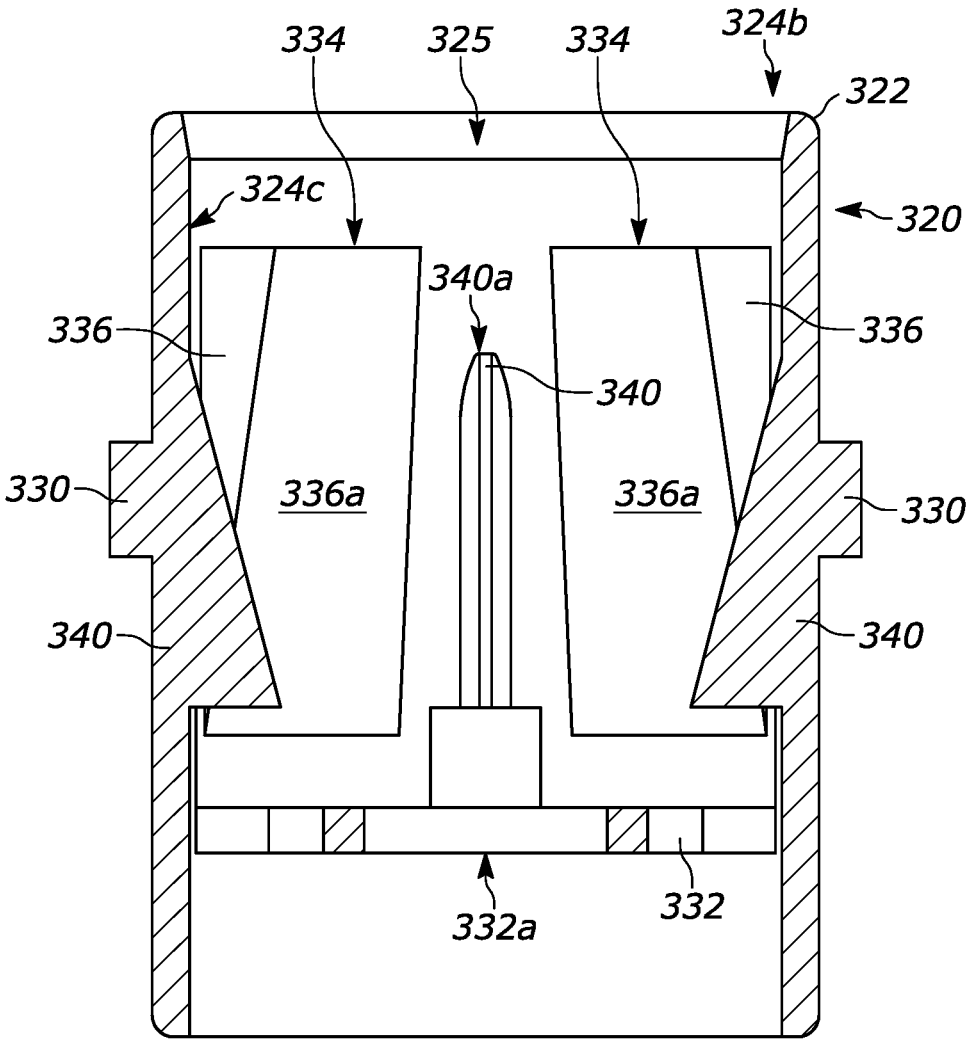
FIG. 14 illustrates a cross-sectional front elevation view of the example retention mechanism of FIG. 13 in accordance with various examples.

In the example retention mechanism 220 illustrated in FIGS. 11 and 12, the angled protrusions 236 positioned adjacent to the floor member 232 include an angled side surface 236*a*, while the remaining angled protrusions 236 may have a differently-oriented side surface 236*a*. In the illustrated example, the additional angled protrusions 236 have a generally vertical side surface 236*a* that is approximately parallel to the longitudinal axis L. Other arrangements are possible.

As previously noted, the retention mechanisms described herein may include any number of stepped surfaces or angled protrusions. In the example retention mechanism 320 illustrated in FIGS. 13 and 14, the retention member 334 is a generally smooth member that does not include additional stepped surfaces. More specifically, some formulations of cosmetic substances 101 may not require the additional stepped surfaces to adequately retain the cosmetic substance 101, so such retention mechanisms 320 may be used to lower manufacturing costs and simplify production.

So configured, the retention mechanism and product described herein securely retains the cosmetic substance without damaging portions thereof. The retention mechanism advantageously increases surface area in shear contact with the cosmetic substance 101 compared with traditional designs, thereby increasing friction to assist with retaining the cosmetic substance 101 within the cup cavity 125 during use, drops, and/or other unintended movements. Further, the presently-described retention mechanism and product do not include additional stress concentration areas that may otherwise result in the cosmetic substance being fractured, stretched, or otherwise damaged during unintentional movements. The retention mechanisms described herein may also provide additional stability to protect the cosmetic substance in the event of a drop or bump event. More specifically, the retention mechanism may maintain alignment of the cosmetic substance so that it does not become misaligned after a drop or bump. Such misalignment may cause the cosmetic substance to contact interior portions of the product during upward application, which in turn may damage or smear the cosmetic substance.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings. Additionally, the described embodiments/examples/implementations should not be interpreted as mutually exclusive, and should instead be understood as potentially combinable if such combinations are permissive in any way. In other words, any feature disclosed in any of the aforementioned embodiments/examples/implementations may be included in any of the other aforementioned embodiments/examples/implementations.

The benefits, advantages, solutions to problems, and any element(s) that may cause any benefit, advantage, or solution to occur or become more pronounced are not to be construed as a critical, required, or essential features or elements of any or all the claims. The claimed invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter may lie in less than all features of a single disclosed embodiment. Thus, the following claims are hereby incorporated into the Detailed Description, with each claim standing on its own as a separately claimed subject matter.

The patent claims at the end of this patent application are not intended to be construed under 35 U.S.C. § 112(f) unless traditional means-plus-function language is expressly recited, such as "means for" or "step for" language being explicitly recited in the claim(s).

What is claimed is:

1. A cup for retaining a cosmetic substance, the cup comprising:

a cup body having a first end, a second end, and an inner sidewall forming a cup cavity; and a stepped retention member disposed on the inner sidewall of the cup body and extending into the cup cavity, the stepped retention member having a first width value extending around a periphery of the inner sidewall;

wherein the stepped retention member includes a plurality of angled protrusions extending inwardly into the cup cavity along the entire height of the stepped retention member.

2. The cup of claim 1, wherein each of the plurality of angled protrusions includes a side surface and a lower surface.

3. The cup of claim 2, wherein the side surface defines a side surface area value and the lower surface defines a lower surface area value, wherein a ratio of the side surface area value to the lower surface area value is between approximately 4:1 and approximately 12:1.

4. The cup of claim 1, further comprising a second retention member disposed on the inner sidewall of the cup body and extending into the cup cavity, the second retention member having a second width value extending around the periphery of the inner sidewall, wherein the first width value is greater than the second width value.

5. The cup of claim 4, wherein the second retention member comprises an elongated notch having a first end, a second end, and an undercut formed at the second end thereof.

6. The cup of claim 4, further comprising a cup retention member disposed on an outer surface of the cup body.

7. The cup of claim 6, wherein the cup retention member is aligned with the second retention member.

8. The cup of claim 1, further comprising a floor member positioned at or near the stepped retention member.

9. A cosmetic product container comprising:

an outer container having a first end and a second end and defining a container cavity;

a cup adapted to be at least partially disposed within the container cavity, the cup including:

a cup body having a first end, a second end, and an inner sidewall forming a cup cavity; and a stepped retention member disposed on the inner sidewall of the cup body and extending into the cup cavity, the stepped retention member having a first width value extending around a periphery of the inner sidewall, and a cosmetic substance having a first end, a second end, and an elongated body therebetween, wherein at least a portion of the elongated body is disposed within the cup cavity;

wherein the stepped retention member includes a plurality of angled protrusions extending inwardly into the cup cavity along the entire height of the stepped retention member.

10. The cosmetic product container of claim 9, wherein each of the plurality of angled protrusions includes a side surface and a lower surface.

11. The cosmetic product container of claim 10, wherein the side surface includes a side surface area and the lower surface includes a lower surface area, wherein a ratio of the side surface area to the lower surface area is between approximately 4:1 and approximately 12:1.

12. The cosmetic product container of claim 9, further comprising a second retention member disposed on the inner sidewall of the cup body and extending into the cup cavity, the second retention member having a second width value extending around the periphery of the inner sidewall, wherein the first width value is greater than the second width value.

13. The cosmetic product container of claim 12, wherein the second retention member comprises an elongated notch having a first end, a second end, and an undercut formed at the second end thereof.

14. The cosmetic product container of claim 12, further comprising a cup retention member disposed on an outer surface of the cup body.

15. The cosmetic product container of claim 14, wherein the cup retention member is aligned with the second retention member.

16. The cosmetic product container of claim 15, wherein the cup retention member is adapted to apply an urging force towards the cup cavity upon inserting the cup into the container cavity.

17. The cosmetic product container of claim 12, further comprising a floor member positioned at or near the stepped retention member, wherein the first end of the cosmetic substance is adapted to abut the floor member.

18. A cup for retaining a cosmetic substance, the cup comprising:

a cup body having a first end, a second end, and an inner sidewall forming a cup cavity;

a stepped retention member disposed on the inner sidewall of the cup body and extending into the cup cavity, the stepped retention member having a first width value extending around a periphery of the inner sidewall;

a second retention member disposed on the inner sidewall of the cup body and extending into the cup cavity, the second retention member having a second width value extending around the periphery of the inner sidewall, wherein the first width value is greater than the second width value.

* * * * *